US011774225B2

(12) United States Patent
Peron

(10) Patent No.: US 11,774,225 B2
(45) Date of Patent: Oct. 3, 2023

(54) FUZE FOR A PROJECTILE INTENDED TO BE FIRED BY A CANNON

(71) Applicant: NEXTER MUNITIONS, Versailles (FR)

(72) Inventor: Jean-Luc Peron, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 158 days.

(21) Appl. No.: 17/429,777

(22) PCT Filed: Feb. 6, 2020

(86) PCT No.: PCT/IB2020/050945
§ 371 (c)(1),
(2) Date: Aug. 10, 2021

(87) PCT Pub. No.: WO2020/165699
PCT Pub. Date: Aug. 20, 2020

(65) Prior Publication Data

US 2022/0357140 A1 Nov. 10, 2022

(30) Foreign Application Priority Data

Feb. 13, 2019 (FR) ..... 1901348

(51) Int. Cl.
*F42C 15/24* (2006.01)
*F42C 15/00* (2006.01)
(Continued)

(52) U.S. Cl.
CPC ..... *F42C 15/005* (2013.01); *F41A 19/58* (2013.01); *F42C 11/008* (2013.01); *F42C 15/24* (2013.01); *F42C 15/40* (2013.01)

(58) Field of Classification Search
CPC ..... F42C 15/005; F42C 11/008; F42C 15/24; F42C 15/40; F41A 19/58
See application file for complete search history.

(56) References Cited

U.S. PATENT DOCUMENTS 3,739,726 A * 6/1973 Pintell ..... F42C 15/40 102/215
3,814,017 A 6/1974 Backstein et al.
(Continued)

FOREIGN PATENT DOCUMENTS

EP 0307307 A1 3/1989
EP 1106959 A1 6/2001
(Continued)

OTHER PUBLICATIONS

Oct. 18, 2019 Search Report and Written Opinion issued in French Patent Application No. 1901348.
(Continued)

*Primary Examiner* — J. Woodrow Eldred
(74) *Attorney, Agent, or Firm* — Oliff PLC

(57) ABSTRACT

A fuze for a projectile intended to be fired by a cannon by ignition of a propellant charge using an electric igniter. This fuze is allowed to pase from a safety position to an armed position following the fire by releasing at least two different safeties. This fuze includes a capacitor which is intended to be connected to the electric igniter and which charges during the ignition of the propellant charge, and also a computer which detects the charge of the capacitor in order to allow the arming of the fuze when this charge is greater than or equal to a reference value, the charge of the capacitor constituting a first fire safety.

10 Claims, 2 Drawing Sheets

(51) Int. Cl.

| | |
|---|---|
| ***F41A 19/58*** | (2006.01) |
| ***F42C 11/00*** | (2006.01) |
| ***F42C 15/40*** | (2006.01) |

(56) References Cited

U.S. PATENT DOCUMENTS

| | | | |
|---|---|---|---|
| 4,015,531 | A | 4/1977 | Ziemba |
| 5,097,765 | A | 3/1992 | Ziemba |
| 5,458,995 | A | 10/1995 | Behl et al. |
| 6,474,239 | B2 | 11/2002 | Leblond et al. |
| 6,644,204 | B2 | 11/2003 | Pierrot et al. |
| 6,951,161 | B2 | 10/2005 | Ceola |
| 7,504,177 | B2 | 3/2009 | Peabody |
| 8,015,923 | B2 | 9/2011 | Caillaut |
| 9,647,276 | B2 | 5/2017 | Degruson et al. |
| 10,062,910 | B2 | 8/2018 | Rastegar |
| 2002/0034681 | A1 | 3/2002 | Rudenauer et al. |
| 2008/0210115 | A1 | 9/2008 | Zinell et al. |
| 2012/0180682 | A1 | 7/2012 | Rastegar |

FOREIGN PATENT DOCUMENTS

| | | | |
|---|---|---|---|
| EP | 1258695 | A1 | 11/2002 |
| EP | 2108916 | A1 | 10/2009 |
| EP | 2573850 | A2 | 3/2013 |
| FR | 2633385 | A1 | 12/1989 |
| IL | 90736 | A | 6/1992 |
| IL | 87694 | A | 5/1994 |
| WO | 2014/088663 | A1 | 6/2014 |
| WO | 2017/069787 | A1 | 4/2017 |

OTHER PUBLICATIONS

May 29, 2020 Search Report issued in International Patent Application No. PCT/IB2020/050945.

May 29, 2020 Written Opinion of the International Searching Authority issued in International Patent Application No. PCT/IB2020/050945.

* cited by examiner

FUZE FOR A PROJECTILE INTENDED TO BE FIRED BY A CANNON

The technical field of the invention is that of fuzes for projectiles intended to be fired by a cannon.

The projectiles fired by a cannon are associated with a propellant charge which, once ignited, generates propellant gases whose pressure enables the projectile to be fired.

These projectiles may be in the form of fixed ammunition, in which the projectile is attached to a cartridge case that contains the propellant charge and carries an igniter for that charge.

These projectiles can also be independent of the propellant charge, which is only associated with them at the time of fire, for example in the case of mortar fire.

In all cases, the projectiles are equipped with a fuze that controls the firing of an explosive or pyrotechnic charge, at a given moment on trajectory, or on impact with a target. The fuze typically includes a safety and arming device to ensure the fire safety.

For many years, military standards (and in particular NATO Stanag No. 4187) have required that safety and arming devices can only be released following the detection of two different events associated with the fire.

Such a recommendation leads to a high level of safety since the release of a single safety is not sufficient to arm the fuze.

It is conventional when defining projectiles fired by a rifled barrel to detect both the fire acceleration and the spin acceleration imparted by the barrel.

Meeting these requirements is more difficult when the projectiles are fired by smoothbore cannons, for example tank cannons or smoothbore mortar tubes.

While the detection of the fire acceleration can always be carried out, the low magnitude of spin of these projectiles does not allow for a reliable reliance on such an event.

For example, U.S. Pat. No. 6,951,161 proposes to combine the detection of the fire acceleration with the counting of a certain number of rotations of the projectile in a given time window. Such a solution requires arranging a rotation sensor, for example a magnetic one, which complicates the design of the fuze.

Patent application US2008/0210115 describes a safety device in which the second event associated with the fire is a measurement of pressure or temperature at the projectile nose. Such a solution is also complex and costly to implement.

Patent FR2633385 describes a device in which the gas pressure in the weapon chamber is detected by pistons that perforate a wall of the projectile to release a safety. This device is also complex and can result in degration of leak tightness between the projectile and the weapon chamber.

U.S. Pat. No. 4,015,531 also describes an electrical fuze comprising a capacitor which is connected by a wire connection to an igniter ensuring the ignition of the propellant charge. This capacitor constitutes the source of energy which ensures the firing of an electric detonator housed in a rotor ensuring a misalignment of the pyrotechnic chain. Such a capacitor cannot constitute a reliable arming safety because it also constitutes the source of energy for firing. Such a fuze does not comply with military standards (and in particular NATO Stanag no. 4187).

U.S. Pat. Nos. 5,097,765 and 3,814,017 show devices incorporating one or more capacitors that operate to power the electronic circuits of the fuze and provide the energy for firing the detonator. These capacitors incorporated in the firing chain cannot be used as fire safeties to bring a fuze up to military standards.

It is the purpose of the invention to propose a fuze that allows for the simple and inexpensive detection of an event associating with the fire that is distinct from the sole axial acceleration due to the fire.

Thus the fuze according to the invention is particularly well suited to the design of fuzes for projectiles and ammunition that can be fired by smooth tubes.

The invention also relates to a piece of ammunition equipped with such a fuze and a method of arming such a fuze.

Thus, the invention relates to a fuze for a projectile intended to be fired by a cannon by ignition of a propellant charge using an electric ignition means, such as an electric igniter, wherein the fuze is allowed to pass from a safety position to an armed position, following the fire, by releasing at least two different safeties, the fuze being characterized in that it comprises a capacitor which is intended to be connected to the electric ignition means for igniting the propellant charge and which charges during the ignition of the latter, and also a computer which detects the charge of the capacitor in order to allow the arming of the fuze when this charge is greater than or equal to a reference value, the charge of the capacitor constituting a first fire safety.

The fuze may comprise an electrical generator which is inertially primed during the fire.

The fuze may comprise an inertial sensor which is connected to the computer and which constitutes a second fire safety.

The fuze may comprise a bridge divider between the electric ignition means and the capacitor.

Advantageously, the capacitor of the fuze may be arranged between the gate and the source of a field-effect transistor, the drain of this capacitor being powered by the electrical generator and being connected to a logic module of the computer, the source also being connected to a ground of the fuze, the threshold voltage $V_{GS}$ of the transistor constituting the reference value.

The invention also relates to a piece of ammunition intended to be fired by a cannon and comprises a projectile and a propellant charge equipped with an electric ignition means, such as an electric igniter, secured to a base, the projectile carrying a fuze according to the preceding characteristics, and a wire connection connecting the fuze to the igniter.

Advantageously, the piece of ammunition may comprise a divider bridge between the electric ignition means and the capacitor, wherein the divider bridge is housed in the base.

The invention also relates to a method of arming a fuze fitted to a projectile when fired by a cannon, in which method the fire is recognized by the detection of at least two different events usually associated with a fire, the combination of the two events making it possible to arm the fuze, the method being characterized by the following steps:

- a capacitor of the fuze charges from a signal for firing a propellant charge,
- the charge of the capacitor is used as a first event associated with the firing and allowing the arming of the fuze, a computer detecting the charge of the capacitor in order to allow the arming of the fuze when this charge is greater than or equal to a reference value.

Advantageously, the fire acceleration can be used as a second event associated with the fire and allowing the arming of the fuze.

Advantageously, an electrical generator that is inertially primed during the fire, is used in this method, the activation of the generator ensuring powering of the fuze.

The invention will be better understood upon reading the description made with reference to the attached drawings, in which.

Figure 1:
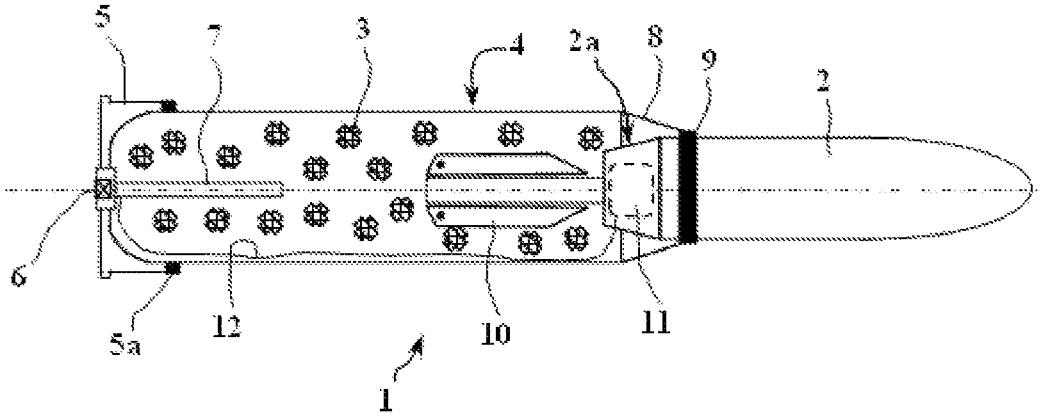
FIG. 1 is a schematic partial longitudinal sectional view of a piece of munition according to the invention.

Referring to FIG. 1, a piece of ammunition 1 according to the invention is intended to be fired by a cannon (not shown), for example a cannon of a 40 mm or greater caliber, such as a 120 mm tank cannon.

This piece of ammunition 1 comprises a projectile 2 and a propellant charge 3, in the form of powder grains, which is housed in a case 4, for example a combustible case. In a conventional manner, the case 4 is sealed at its rear part by a metal base 5 which carries an annular seal 5*a*. The base 5 comprises an axial bore which receives an electric ignition means 6 (such as an igniter), secured to an igniter tube 7.

Bases equipped with igniter tubes are well known to those skilled in the art. For example, reference may be made to patents EP2108916 and EP1258695 which describe closing bases attached to combustible cases and patent EP1106959 which describes an igniter tube.

The projectile 2 is attached to the case 4 at a front connecting part 8 and is equipped with a sealing band 9. Patent EP307307 describes an example of a connection part between a projectile and a combustible case.

The projectile 2 carries at its rear part a deployable tail unit 10, which is pivotally mounted on pins secured to a tail fin 11.

The projectile 2 is for example an explosive projectile having a metal body containing an explosive material (not shown). The explosive material can be initiated by a fuze 11 (shown in dotted line) which is housed in a base 2*a* of the projectile 2.

In accordance with a feature of the invention, the fuze 11 is connected to the igniter 6 (or more precisely to the electric contact powering the igniter 6) by a wire connection 12. The wire connection 12 may for example be glued to the inner wall of the combustible case 4.

The fuze 11 can also be a programmable fuze. The wire connection 12 connected to the igniter 6 can therefore be associated with another wire connection (not visible in FIG. 1) which will be connected to a contact stud on the base allowing before the fire to enter signals for programming the fuze 11.

Figure 2:
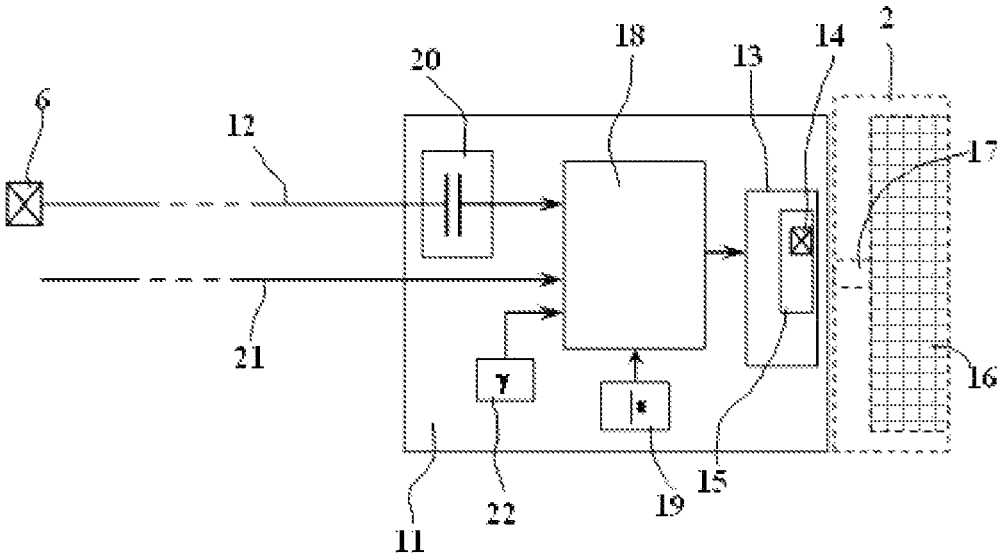
FIG. 2 is a simplified representation of a fuze according to the invention.

FIG. 2 shows schematically the fuze 11 of the projectile 2.

The fuze 11 comprises a safety and arming device 13 which carries a detonator 14 secured to a movable flap 15.

The detonator 14 is intended to initiate the explosive charge 16 which is housed in the body of the projectile 2.

This safety and arming device 13 is not shown in detail as such devices are well known. The movable flap 15 (movable in rotation or translation) enables the detonator 14 and the explosive charge 16 to be misaligned (or more precisely to misalign the detonator 14 and an orifice 17 allowing the passage of the detonation wave and which allows it to attack the explosive charge 16).

The safety and arming device 13 moves from a safety position (in which the detonator 14 cannot initiate the explosive charge 16) to an armed position in which the detonator 14 is actually aligned with the orifice 17, and can therefore cause the explosive charge 16 to detonate.

This transition from the safety position to the armed position can only be achieved by releasing at least two different safeties, which releasing occurs following the piece of ammunition 1 being fired.

The fuze 11 thus comprises a computer 18 which is intended to control the transition of the safety and arming device 13 to its armed position. The computer 18 is for example in the form of a microprocessor which is powered by an electrical generator 19.

FIG. 2 also shows a wire connection 21 which connects the computer 18 to a programming contact secured to the base 5. This wire connection is intended to enter into a memory of the computer 18 a programming value, for example for programming the firing time.

The electrical generator 19 is advantageously a generator that is inertially primed during the fire, for example a primable battery.

Such generators are well known (see for example patents U.S. Pat. No. 7,504,177, DE50115732 and U.S. Pat. No. 9,647,276). They comprise an electrolyte which is contained in an envelope broken by inertial forces during the fire. The electrolyte is thus positioned between the electrodes of the battery which can then deliver a current.

It is also advantageous to use a thermal battery comprising a pyrotechnic composition which is ignited by a slapper released by the fire acceleration. Such thermal batteries are also well known, for example by patents: EP2573850, WO2017069787, U.S. Pat. Nos. 5,458,995 and 10,062,910.

According to the invention, the fuze comprises a capacitor 20 which is connected by the wire connection 12 to an electric means for igniting the propellant charge, in this case the igniter 6.

In practice, the capacitor 20 is connected in parallel with the igniter 6 and part of the ignition current for the igniter 6 is thus diverted to the capacitor 20, which therefore only charges when the projectile 2 is actually fired. In order to limit the intensity of the current carried by the wire connection 12, a voltage divider may be provided, which will be located in the vicinity of the initiator 6. This solution will be described hereinafter.

Of course, FIG. 2 is very schematic and one terminal of the capacitor 20 is connected to the supply pole of the igniter 6 while the other terminal of the capacitor 20 is connected to the electric ground of the weapon. This grounding is done using the base 5 (as for the igniter) and the wire connection 12 is then a two-wire connection. The grounding can also be made using the body of the projectile 2 which is in contact with the barrel of the weapon (and the wire connection 12 can then be monowire).

The capacitor 20 is connected to the computer 18, which can thus detect whether the capacitor 20 is charged or not.

The computer 18 is not powered before the fire, since it is the activation of the electrical generator 19 by the fire acceleration that supplies it with current.

Once activated, the computer 18 will measure the charge level of the capacitor 20, for example by comparison with a reference value stored in memory, or more simply by toggling a solid state relay whose toggling level (reference value) is set by an electronic circuit (incorporated in the fuze 11) to a level corresponding to the minimum discharge current of the capacitor 20 that is expected.

The method of arming a fuze according to the invention thus comprises the following two steps:

- a capacitor in the fuze charges from a signal for firing a propellant charge, the charge of the capacitor is used as a first event associated with the firing and allowing the arming of the fuze.

It is therefore the sufficient charge level of the capacitor 20 that constitutes the first fire safety of the fuze 11. If this level is insufficient, it means that a propellant charge has not been ignited.

The computer 18 does not then control the arming of the safety and arming device 13 and the detonation of the explosive charge 16 cannot occur.

The second fire safety device consists of an inertial sensor (such as an accelerometer 22) which detects the fire acceleration. The accelerometer 22 is connected to the computer 18 which includes a logic module that verifies the presence of the two events, which releases the safety and arming device 13 of the fuze 11.

The safety and arming device 13 of the fuze 11 can therefore only transition from a safety position to an armed position after releasing two different safeties: the detection of the ignition current for the propellant charge and the detection of the longitudinal fire acceleration.

Even a violent shock, which could be detected by the accelerometer 22, cannot arm the safety and arming device 13 since the ignition current for the propellant charge is absent.

Even a long burn during the ignition of the propellant charge cannot arm the safety and arming device 13 since the fire acceleration has not occurred.

An accidental ignition of the propellant charge, for example as a result of a blaze, cannot release the arming safety either, since the electric current for the igniter 6 is then absent and could not have charged the capacitor 20.

The invention therefore defines a fuze 11 that meets the highest safety requirements without the need to equip the safety and arming device with an additional inertial lock.

As an alternative, it is of course possible to associate the capacitor 20 with a mechanical inertial lock immobilizing the flap 15 of the safety and arming device 13. This inertial lock will form the second safety.

Of course, while the capacitor 20 is functionally attached to the fuze 11, it may structurally be arranged outside the fuze, for example in a specific housing of the projectile body 2.

Advantageously, the computer 18 of the fuze 11 will itself constitute the safety and arming device, without the need for a mobile flap 15.

This can be achieved by using a slapper-type detonator 14. These detonators are relatively insensitive and can only be activated by a high voltage, and furthermore they deliver sufficient energy to initiate a secondary explosive, which is therefore also less sensitive. It is therefore possible (and authorized by the standardization bodies) to use a slapper without a mechanical flap to ensure misalignment of the pyrotechnic chain, but on condition that two independent fire safeties are provided to control the operation of the fuze.

The firing safety is then ensured by the fuze itself, which can only command the slapper after the two fire safeties have been released. In this case, the fire safeties will be logical locks which are independent of each other and which must be distinct from the firing chain itself.

Figure 3:
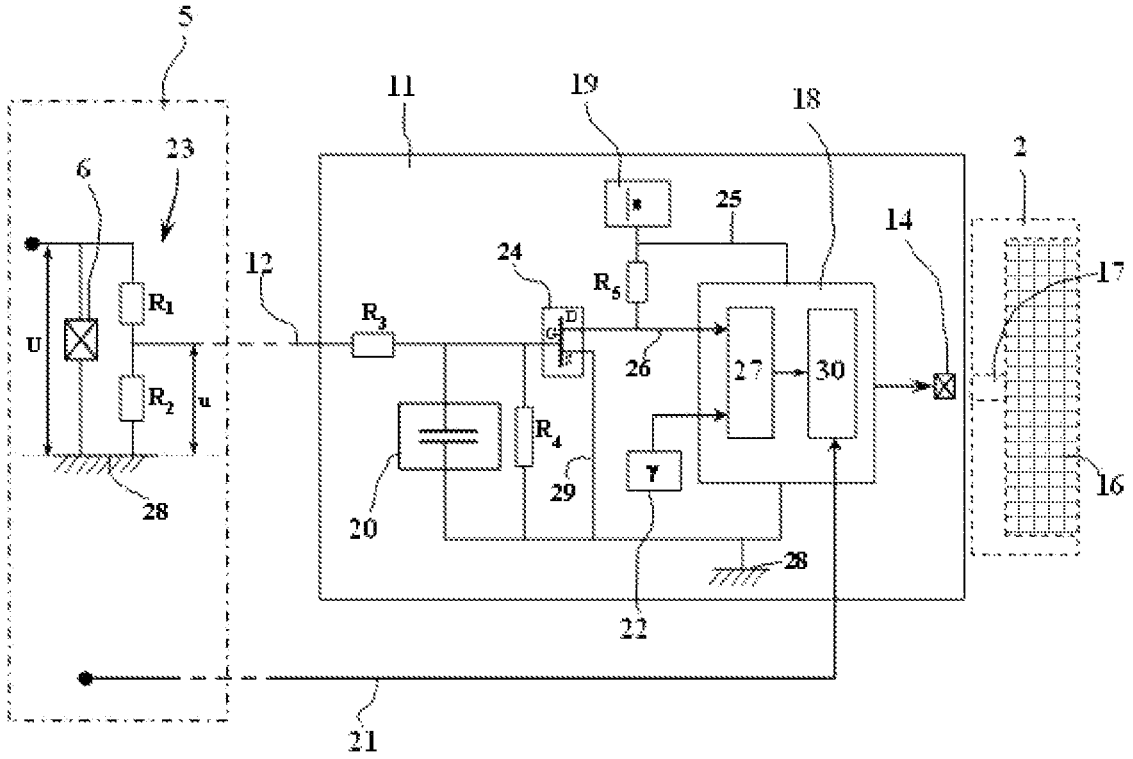
FIG. 3 shows an example of embodiment of a fuze according to the invention.

FIG. 3 shows an example of a fuze 11 according to the invention and incorporating an exploding foil detonator 14.

As previously mentioned, the wire connection 12 is connected to the igniter 6 by a voltage divider bridge 23 which comprises two resistors $R_1$ and $R_2$. Thus, in a conventional way, the voltage u carried by the wire connection 12 is reduced in relation to the ignition voltage U of the igniter 6. We have $u=U\ R_2/(R_1+R_2)$.

The divider bridge 23, even though it is functionally part of the fuze 11, is structurally arranged at the base 5. This reduces the current flowing in the wire connection 12.

It would of course be possible to house the divider bridge 23 in the projectile, but this has no practical advantages as the current flowing in the wire connection 12 would be the same as that of the firing, which may cause problems of insulation and fire safety.

The capacitor 20 is powered through a charging resistor $R_3$, another resistor $R_4$ is connected in parallel between the terminals of the capacitor 20. The purpose of the resistor $R_4$ is to allow the discharge of the capacitor 20, after detection of its charged state by the computer 18, during the flight of the projectile. It thus allows the discharge of parasitic charges that could disturb the operation of the fuze. $R_3$ and the capacitor 20 form a low-pass filter that eliminates parasitic high frequencies.

Since the firing of the igniter 6 ignites the propellant charge, it causes the capacitor 20 to charge.

It can be seen that the fuze includes a field-effect transistor 24 (MOS transistor) whose Drain (D) is powered by the electrical generator 19 (when the latter is primed). The capacitor 20 is arranged between the Gate (G) and the Source (S) of the transistor 24.

When the electrical generator 19 is primed, it powers the computer 18 (connection 25) but also applies a $V_{DS}$ voltage, via the connection 26, to a logic module 27 of the computer 18.

When the capacitor 20 is charged to a voltage u which is higher than the threshold voltage $V_{GS}$ of the MOS transistor (which thus constitutes the reference value of the first fire safety of the fuze 11), the MOS transistor 24 closes and the current coming from the generator 19 drains to the ground 28 via the connection 29. This results in a voltage close to 0 volts being applied to the logic module 27 of the computer via the connection 26. The charging resistor $R_5$ prevents the generator 19 from being short-circuited.

Here this toggling of the MOS 24 is considered as a change from 1 to 0. But this is not of practical importance because inverting logic components can be implemented at the logic module 27 to detect the desired combination.

If the capacitor 20 is not charged, it is because no firing of the propellant charge has been detected. MOS transistor 24 then remains open and the $V_{DS}$ voltage is equal to the voltage of the electrical generator 19, i.e. a logic 1 state. This logic 1 state indicates to the logic module 27 that the safety has not been released, the fuze 11 is not armed and the initiation of the slapper detonator 14 is not possible.

In addition, the logic module 27 detects the fire acceleration found by the accelerometer 22.

The components and logic wiring are chosen so that only the combination of the presence of a fire acceleration and a charge of the capacitor 20 enables the operation of the fuze 18, and in particular of a module 30 for controlling the firing of the slapper detonator 14.

The fuze 11, and more particularly the firing control module 30, also receives, as described above, the wire connection 21 enabling programming the desired operating mode for the fuze.

It can therefore be seen that the first fire safety system according to the invention uses information of an electrical nature which is stored in the fuze 11 before the latter can operate, the electrical generator 19 not yet being operational. However, the chronology of a fire is sufficiently rapid for the information thus stored to be readable by the fuze when it can operate. The discharge of the capacitor 20 occurs only gradually, through the resistor R4, after the safety has been released. The capacitor 20 does not intervene in the firing of the slapper detonator 14. The energy for this firing comes from the electrical generator 19.

The invention is more particularly suited to ammunition fired by a smoothbore cannon barrel. It is clear, however, that it can be implemented with a piece of ammunition fired by a rifled barrel. The fire event associated with the ignition of the propellant charge can then be combined with either an axial acceleration of the projectile or a spin acceleration.

The invention claimed is:

1. A fuze for a projectile intended to be fired by a cannon by ignition of a propellant charge using an electric ignition means, wherein the fuze is allowed to pass from a safety position to an armed position, following a fire, by releasing at least two different fire safeties, wherein the fuze comprises a capacitor which is intended to be connected to the electric ignition means for igniting the propellant charge and which charges during the ignition of the propellant charge, and the fuze also comprises a computer which detects the charge of the capacitor in order to allow the arming of the fuze when this charge is greater than or equal to a reference value, the charge of the capacitor constituting a first fire safety.

2. The fuze according to claim 1, wherein the fuze comprises an electrical generator which is inertially primed during the fire.

3. The fuze according to claim 1, wherein the fuze comprises an inertial sensor which is connected to the computer and which constitutes a second fire safety.

4. The fuze according to claim 1, wherein the fuze comprises a divider bridge between the electric ignition means and the capacitor.

5. The fuze according to claim 2, wherein the capacitor is arranged between the gate G and the source S of a field-effect transistor, the drain D of this capacitor being powered by the electrical generator and being connected to a logic module of the computer, the source S also being connected to a ground of the fuze, the threshold voltage $V_{GS}$ of the transistor constituting the reference value.

6. A piece of ammunition intended to be fired by a cannon and comprising a projectile and a propellant charge equipped with an electric ignition means secured to a base, the projectile carrying a fuze according to claim 1, wherein a wire connection connects the fuze to the electric ignition means.

7. The piece of ammunition according to claim 6, wherein the piece of ammunition comprises a divider bridge between the electric ignition means and the capacitor, wherein the divider bridge is housed in the base.

8. A method of arming a fuze fitted to a projectile when fired by a cannon, in which method a fire is recognized by the detection of at least two different events usually associated with a fire, the combination of the two events making it possible to arm the fuze, the method comprising the following steps:

a capacitor of the fuze charges from a signal for firing a propellant charge, the charge of the capacitor is used as a first event associated with the fire and allowing the arming of the fuze, a computer detecting the charge of the capacitor in order to allow the arming of the fuze when this charge is greater than or equal to a reference value.

9. The method of arming a fuze according to claim 8, in which method a fire acceleration is used as a second event associated with the fire and allowing the arming of the fuze.

10. The method of arming a fuze according to claim 8, in which method an electrical generator that is inertially primed during the fire, is used, activation of the generator ensuring powering of the fuze.

* * * * *